US007394426B2

(12) United States Patent
Ogawa et al.

(10) Patent No.: US 7,394,426 B2
(45) Date of Patent: Jul. 1, 2008

(54) CIRCULAR POLARIZED ANTENNA, ANTENNA DESIGN SIMULATOR, AND WIRELESS MODULE WITH THE ANTENNA

(75) Inventors: Tomoyuki Ogawa, Hitachi (JP); Ken Takei, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 319 days.

(21) Appl. No.: 11/352,405

(22) Filed: Feb. 13, 2006

(65) Prior Publication Data

US 2006/0181460 A1 Aug. 17, 2006

(30) Foreign Application Priority Data

Feb. 14, 2005 (JP) ..... 2005-036002

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/702, 845, 895
See application file for complete search history.

(56) References Cited

U.S. PATENT DOCUMENTS 7,026,997 B2 * 4/2006 Rahola ..... 343/700 MS
2004/0217916 A1 * 11/2004 Quintero Illera et al. .... 343/895

FOREIGN PATENT DOCUMENTS

JP 5-152830 6/1993
JP 8-51312 2/1996
JP 2001-251132 9/2001

* cited by examiner

*Primary Examiner*—Shih-Chao Chen
(74) *Attorney, Agent, or Firm*—McGinn IP Law Group, PLLC

(57) ABSTRACT

A circular polarized antenna has a group of conductor lines that comprise a planar metal conductor, and a feeding point connected to a part of the conductor lines. When a current to be induced on the conductor lines is projected onto two mutually-perpendicular axes to define projections and arguments therebetween, a ratio between absolute values of the projections is 0.7 to 1.3 and an absolute value of a difference between the arguments is 80 to 100 degrees, and a reactance component of an impedance of the feeing point is nearly zero.

10 Claims, 8 Drawing Sheets

CIRCULAR POLARIZED ANTENNA, ANTENNA DESIGN SIMULATOR, AND WIRELESS MODULE WITH THE ANTENNA

The present application is based on Japanese patent application No. 2005-036002 filed Feb. 14, 2005, the entire contents of which are incorporated herein by reference.

BACKGROUND OF THE INVENTION

1. Field of the Invention

This invention relates to a circular polarized antenna, a design simulator for the antenna and a wireless module with the antenna.

2. Description of the Related Art

Circular polarized antennas are used in the field of BS (broadcasting satellite) and GPS (global positioning system) to allow good reception regardless of inclination of polarization plane. As a representative circular polarized antenna, a one-point feeding microstrip antenna is well known (e.g., Haneishi Misao et al., "Small and Planar Antennas", The Institute of Electronics, Information and Communication Engineers, pp. 142-164, 1996, Corona Corporation). A circular polarized antenna can be designed by providing the microstrip antenna with a degenerate separation element to generate two modes orthogonal spatially. However, the antenna has a limitation in size that its radiating element has one side with a length of about half its working wavelength and, therefore, it is hard to downsize.

Since it is desired that wireless modules have a small and low-profiled antenna, various methods for downsizing, low-profiling and designing thereof are researched.

Some methods for downsizing, low-profiling and designing the one-point feeding circular polarized antenna are disclosed in, e.g., JP patent No. 2826224, JP-A-H08-51312, and JP-A-2001-251132.

JP patent No. 2826224 discloses a method that a notch is formed at both ends of a conductor in the direction of lines orthogonal at ±45 degrees to two resonance mode directions orthogonal to each other and with different phases by a degenerate separation element, either of the lines orthogonal at to at ±45 degrees to the resonance mode directions is made to agree to a deviation direction of the feeding point, whereby its resonance frequency is reduced to allow the downsizing of the antenna at a certain frequency.

JP-A-H08-51312 discloses a method that the antenna is downsized by using a liner antenna element having a loop base element.

JP-A-2001-251132 discloses a method that its radiating element is formed a single-wire rectangular spiral and its outermost perimeter length is more than its working wavelength and twice or less of the working wavelength so as to downsize the antenna.

However, in the method of JP patent No. 2826224, although the downsizing can be attained while keeping the two orthogonal modes needed to generate a circular polarized wave, it is hard to have good matching to the high-frequency circuit. Although a method of adjusting the reactance of input impedance is disclosed therein, the adjustment of resistance needs many trials and errors and, therefore, the design time must be prolonged.

In the method of JP-A-H08-51312, although good circular polarized wave can be generated by adjusting the aspect ratio of the rectangular loop element and the distance between the element and the grounding conductor, it is hard to have good matching to the high-frequency circuit. Although a method of adjusting the input impedance by loading a reactance in the radiating element and a method of adjusting the input impedance by parallel connecting the plural radiating elements are disclosed therein, its systematic design is hard to conduct and, therefore, the design time must be prolonged.

In the method of JP-A-2001-251132, although the downsizing is easy attained by making the radiating element spiral, it is needed that the structure is frequently adjusted in consideration of two conditions of the generation of circular polarized wave and the matching to the high-frequency circuit. Therefore, the design time must be prolonged.

SUMMARY OF THE INVENTION

It is an object of the invention to provide a downsized and low-profiled circular polarized antenna that has good circular polarization characteristics and good matching to the high-frequency circuit.

It is a further object of the invention to provide a antenna design simulator that can design the antenna systematically and fast.

(1) According to one aspect of the invention, a circular polarized antenna comprises:

a group of conductor lines that comprise a planar metal conductor; and a feeding point connected to a part of the conductor lines, wherein when a current to be induced on the conductor lines is projected onto two mutually-perpendicular axes to define projections and arguments therebetween, a ratio between absolute values of the projections is 0.7 to 1.3 and an absolute value of a difference between the arguments is 80 to 100 degrees, and a reactance component of an impedance of the feeing point is nearly zero.

In the above invention, the following modifications and changes can be made.

(i) The metal conductor is divided into a finite number of segments, and the group of conductor lines are formed by removing a part of the segments.

(2) According to another aspect of the invention, an antenna design simulator comprises:

connecting a feeding point to a part of a group of conductor lines that comprise a planar metal conductor;

computing a current to be induced on the conductor lines;

projecting the current onto two mutually-perpendicular axes to define projections and arguments therebetween;

judging whether a ratio between absolute values of the projections is 0.7 to 1.3;

judging whether an absolute value of a difference between the arguments is 80 to 100 degrees; and judging whether an impedance of the feeing point is matched to an impedance of a high-frequency circuit.

In order to generate a circular polarized wave, it is needed that, in a plane perpendicular to the radiation direction of circular polarized wave, the intensity of polarization components in mutually-perpendicular directions is nearly equal, and the absolute value of a phase difference therebetween is nearly 90 degrees.

The radiation characteristics of antenna are obtained by computing the radiation characteristics of each current flowing into the conductor and superposing the computed results (see, e.g., Arai, "New Antenna Engineering", p. 9, Sogo-Densi Publishing Co., 2001). Radiation characteristics near the antenna need to be computed by the above computing method since the antenna size is not negligible.

However, when a radiated field at a very far point is supposed like between the earth and a satellite, the antenna can be estimated as a point since the antenna size is relatively very small. In such a case, the intensity and phase of the radiated field almost reflect the sum of intensity and phase of each current flowing into the antenna. Namely, it can be assumed that the intensity of the radiated field is proportional to the sum of the intensity of the respective currents, and the phase of the radiated field is equal to the sum of the phase of the respective currents.

In view of the above matters, the antenna design simulator of the invention is designed such that the intensity and phase of the polarization component at the radiated field are computed as the sum of the intensity and phase, respectively, of the respective currents.

Therefore, since the radiation characteristics of each current does not need to be computed separately, the design time can be shortened.

In the above invention (2), the following modifications and changes can be made.

(ii) The antenna design simulator further comprises:

a computing means that is operable to repeatedly change a structure of the conductor lines to allow the feeding point to have an impedance match to a high-frequency circuit, wherein every time when the structure of the conductor lines is changed, the simulator judges whether the ratio between absolute values of the projections is 0.7 to 1.3, and whether the absolute value of the difference between the arguments is 80 to 100 degrees.

Thus, the efficiency of the design can be enhanced since the antenna structure to satisfy the circular polarization conditions is searched in the process of the impedance design.

(iii) The metal conductor is divided into a finite number of segments, and the group of conductor lines are formed by removing a part of the segments.

(iv) The current is estimated by using the moment method between segments in at least two directions not parallel to each other.

(v) The antenna design simulator further comprises:

a first storage that stores a matrix Z of rank N with the order of an impedance;

a second storage that stores a vector V of rank N with the order of a voltage;

a third storage that stores a matrix z of rank n (n<N) obtained by deleting plural rows and columns from the matrix Z;

a fourth storage that stores a vector v obtained by deleting plural rows from the vector V;

a fifth storage that stores a matrix y of rank n with the order of an admittance to define an inverse matrix of the matrix z;

a sixth storage that stores a vector i of rank n with the order of a current obtained as a product of the matrix y and the vector v; and a computing means that designs a vector i by using the first to sixth storages, wherein provided that components obtained when components i1 to i7 of the vector i are projected onto two mutually-perpendicular axes are represented as x1 to xn and y1 to yn, the vector i is designed such that an absolute value of the sum of x1 to xn is nearly equal to an absolute value of the sum of y1 to yn, the vector i is designed such that an absolute value of a difference between an argument of the sum of x1 to xn and an argument of the sum of y1 to yn is nearly 90 degrees, and the vector i is designed such that, provided that $z_f$ is the impedance of the high-frequency circuit, $i_e$ is a component corresponding to the feeding point of the vector i, and $v_e$ is a component corresponding to the feeding point of the vector v, the $z_f$ is nearly equal to $v_e/i_e$, or such that a voltage standing wave ratio represented by:

$(1+|(v_e/i_e-z_f)/(v_e/i_e+z_f)|)/(1-|(v_e/i_e-z_f)/(v_e/i_e+z_f)|)$ is minimized.

(vi) The antenna design simulator further comprises:

a tenth storage that stores a removal candidate segment to be removed from the divided segments of the metal conductor;

a seventh storage that stores an absolute value of the sum of x1 to xn and an absolute value of the sum of y1 to yn, provided that components obtained when components i1 to i7 of a vector I are projected onto two mutually-perpendicular axes are represented as x1 to xn and y1 to yn, the vector I being computed by the computing means by using the first to sixth storages for each current of the removal candidate segment;

an eighth storage that stores an argument of the sum of x1 to xn and an argument of the sum y1 to yn; and a ninth storage that stores a voltage standing wave ratio when $z_f$ is the impedance of the high-frequency circuit, $i_e$ is a component corresponding to the feeding point of the vector I, and $v_e$ is a component corresponding to the feeding point of the vector v, wherein the computing means repeatedly computes the voltage standing wave ratio of the removal candidate segment from the tenth storage until the removal candidate segment does not exist, and judges, in reference to the seventh to ninth storages, a removal candidate segment that allows that an absolute value of the sum of x1 to xn is nearly equal to an absolute value of the sum of y1 to yn, that an absolute value of a difference between an argument of the sum of x1 to xn and an argument of the sum of y1 to yn is nearly 90 degrees, and that the voltage standing wave ratio is smaller than a predetermined value, and the simulator further comprises an output means that outputs the judged removal candidate segment.

(3) According to another aspect of the invention, a wireless module comprises:

the circular polarized antenna as defined in (1).

(4) According to another aspect of the invention, a wireless module comprises:

a circular polarized antenna designed by the antenna design simulator as defined in (2).

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

A circular polarized antenna to be designed by an antenna design simulator of the invention will be explained below with reference to FIGS. 6 and 7.

Figure 6:
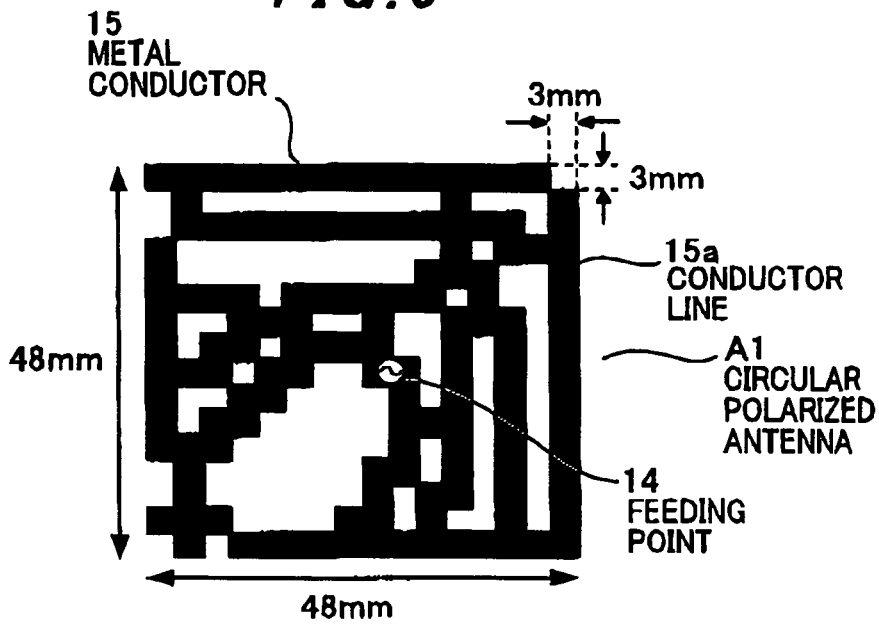
FIG. 6 is a structural diagram showing a circular polarized antenna in a preferred embodiment according to the invention.

FIG. 6 is a structural diagram showing a circular polarized antenna in a preferred embodiment according to the invention. FIG. 7 is schematic diagram illustrating an initial condition in conducting the design algorism of the invention.

As shown in FIG. 6, the circular polarized antenna A1 operable to transmit and receive a circular polarized wave is constructed such that a feeding point 14 is connected nearly at the center of a planar metal conductor 15 and the metal conductor 15 is suitably notched to form a group of conductor lines 15*a*.

Figure 7:
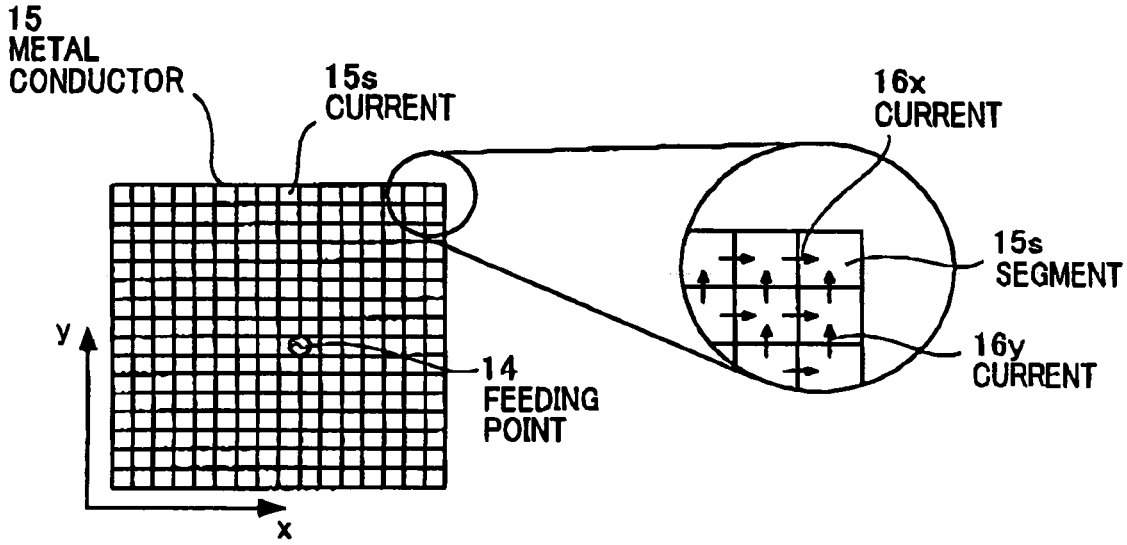
FIG. 7 is schematic diagram illustrating an initial condition in conducting the design algorism of the invention.

The circular polarized antenna A1 is designed by, as shown in FIG. 7, dividing the metal conductor 15 into plural segments 15*s*. The example as shown in FIGS. 6 and 7 is provided with the metal conductor 15 of 48 mm×48 mm in outer size, and the metal conductor 15 is divided into 16×16 parts in x and y directions to have the segments 15*s* of 3 mm×3 mm.

The current of each segment 15*s* is defined as currents 16*x*, 16*y* between the segments 15*s* which are projected on two axes x and y orthogonal to each other.

In operation, every time when each one of the segments 15*s* is removed, the currents 16*x*, 16*y* between the segments 15*s* are projected thereon, the absolute value and argument of the sum of these currents are computed and the voltage standing wave ratio is computed. Thus, arbitrary segment 15*s* is removed until when a design target is attained. As a result, as shown in FIG. 6, the circular polarized antenna A1 can be obtained in which the absolute values of the projections onto the two mutually-perpendicular axes of a current induced on the conductor line 15*a* are nearly equal to each other, the absolute value of a difference between the arguments is nearly 90 degrees, and the reactance component of an impedance of the feeding point 14 is about zero.

When the removal parts of the segment 15*s* are set to be zero, the impedance and the current can be easy computed by a computer by using a matrix with a certain rank and an admittance matrix, respectively.

Figure 1:
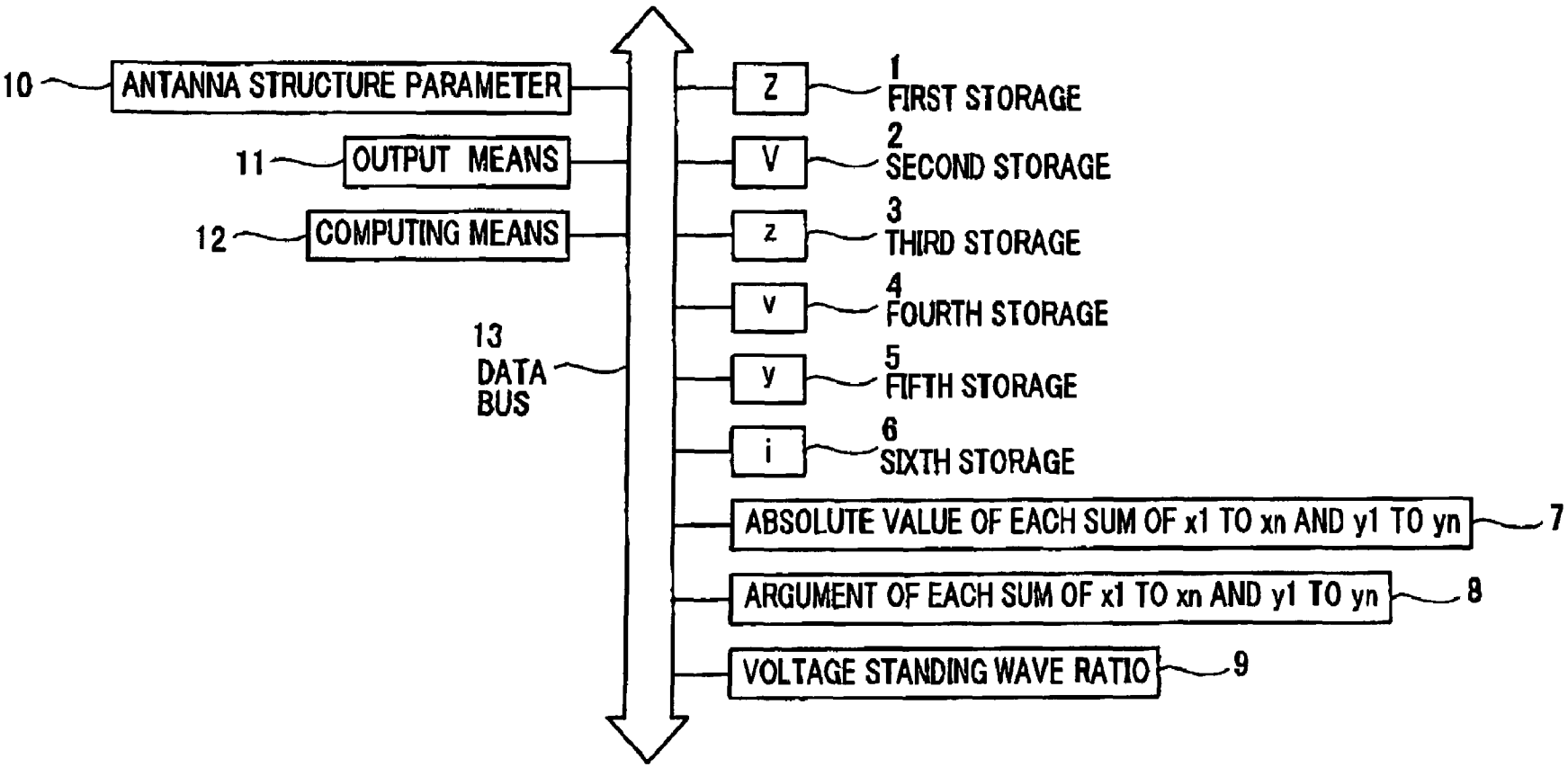
FIG. 1 is a schematic diagram illustrating an antenna design simulator in a preferred embodiment according to the invention of the invention.

FIG. 1 is a schematic diagram illustrating an antenna design simulator in a preferred embodiment according to the invention of the invention.

Referring to FIG. 1, 1 is a first storage which stores a matrix Z of rank N with the order of impedance, 2 is a second storage which stores a vector V of rank N with the order of voltage, 3 is a third storage which stores a matrix z of rank n (n<N) obtained by deleting plural rows and columns from the matrix Z, 4 is a fourth storage which stores a vector v obtained by deleting plural rows from the vector V, 5 is a fifth storage which stores a matrix y of rank n with the order of admittance to define an inverse matrix of the matrix z, 6 is a sixth storage which stores a vector i of rank n with the order of current obtained as a product of the matrix y and the vector v, 7 is a seventh storage which computes and stores the absolute value of the sum of x1 to xn and the absolute value of the sum of y1 to yn when x1 to xn and y1 to yn are each given as a component projected onto at least one set of the two mutually-perpendicular axes x, y of components i1 to in of the vector i, 8 is an eighth storage which computes and stores the argument of the sum of x1 to xn and the argument of the sum of y1 to yn, 9 is a ninth storage which computes and stores a voltage standing wave ratio:

$$(1+|(v_e/i_e-z_f)/(v_e/i_e+z_f)|)/(1-|(v_e/i_e-z_f)/(v_e/i_e+z_f)|) \quad \text{[expression 1]}$$

where $z_f$ is the impedance of a high-frequency circuit to feed electric power to the antenna, $i_e$ is a component corresponding to the feeding point of the vector i, and $v_e$ is a component corresponding to the feeding point of the vector v, and 10 is a tenth storage which stores parameters of an antenna structure to be designed.

The first to tenth storages 1 to 10 are connected through a data bus 13 to a computing means 12 and an output means 11.

The first to tenth storages 1 to 10 can be implemented using a memory such as ROM and RAM in a microcomputer.

The simulator in FIG. 1 is operated such that the parameters of an antenna structure to be designed are inputted to the tenth storage, the computing means such as a CPU installed in the microcomputer computes, based on the parameters, the vectors in reference to the first to sixth storages 1 to 6, and computes the antenna structure and its characteristics to satisfy nearly the design target in reference to the seventh to tenth storages 7 to 10, and the results are outputted to the output means 11 to offer the desired antenna.

Figure 2:
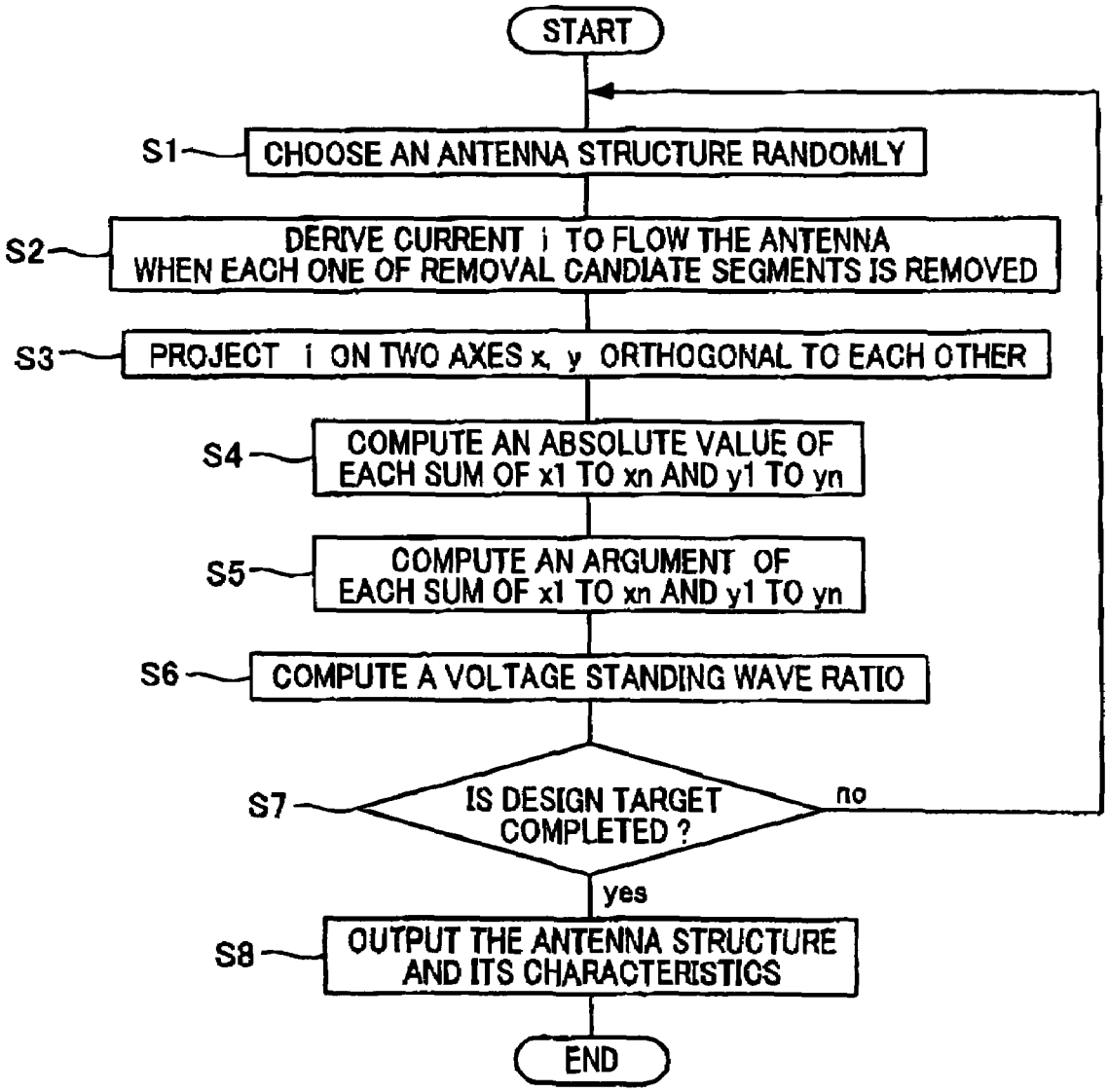
FIG. 2 is a flow chart showing a design algorism of the antenna design simulator in FIG. 1.

FIG. 2 is a flow chart showing a design algorism of the antenna design simulator in FIG. 1.

First, an antenna structure is chosen randomly (S1), and then a current vector i to flow the antenna is derived by using the moment method to estimate current in at least two directions (S2). The components $i_1$ to $i_n$ of the vector i are projected on at least one set of the two mutually-perpendicular axes x, y (S3), and then, provided that each component thereof is represented as x1 to xn and y1 to yn, the absolute value of the sum of x1 to xn and the absolute value of the sum of y1 to yn are computed (S4). The argument of the sum of x1 to xn and the argument of the sum of y1 to yn are computed (S5), the voltage standing wave ratio is computed (S6), and it is judged whether the design target is attained (S7). If the design target is attained, the antenna structure and the characteristics are outputted (S8) and the algorism ends, and if not attained, the steps S1 to S7 are repeated.

The design target can be determined by that 1) the absolute value of the sum of x1 to xn is nearly equal to the absolute value of the sum of y1 to yn, where as a concrete value, the ratio between the absolute values of the sum of the axes x, y is 0.7 to 1.3, preferably 0.9 to 1.1, 2) the absolute value of a difference between the argument of the sum of x1 to xn and the argument of the sum of y1 to yn is nearly 90 degrees, where as a concrete value, the absolute value of a difference between the respective arguments of the sum is 80 to 100 degrees, and 3) the voltage standing wave ratio is smaller than a predetermined value, where as a concrete value, it is 3.0 or less, preferably 2.0 or less.

As described above, the antenna design simulator of the invention can be applied to the computer-aided automatic design of a circular polarized antenna. It can shorten the design time and reduce the designer's burden.

The tenth storage 10 that stores the parameters of the antenna structure as shown in FIG. 1 is, for the simulation, inputted with various parameters such as a transmission/reception frequency, an impedance of high-frequency module, an outer size of the metal conductor, the number of divided segments, the position of the feeding point, antenna shapes obtained by removing arbitrary segments, etc. Of these parameters, the transmission/reception frequency, the impedance of high-frequency module, the outer size of the metal conductor, the number of divided segments, and the position of the feeding point can be uniquely determined by the design target. Therefore, the antenna design depends upon which of the divided segments is to be removed to obtain antenna characteristics as the design target.

Figure 3:
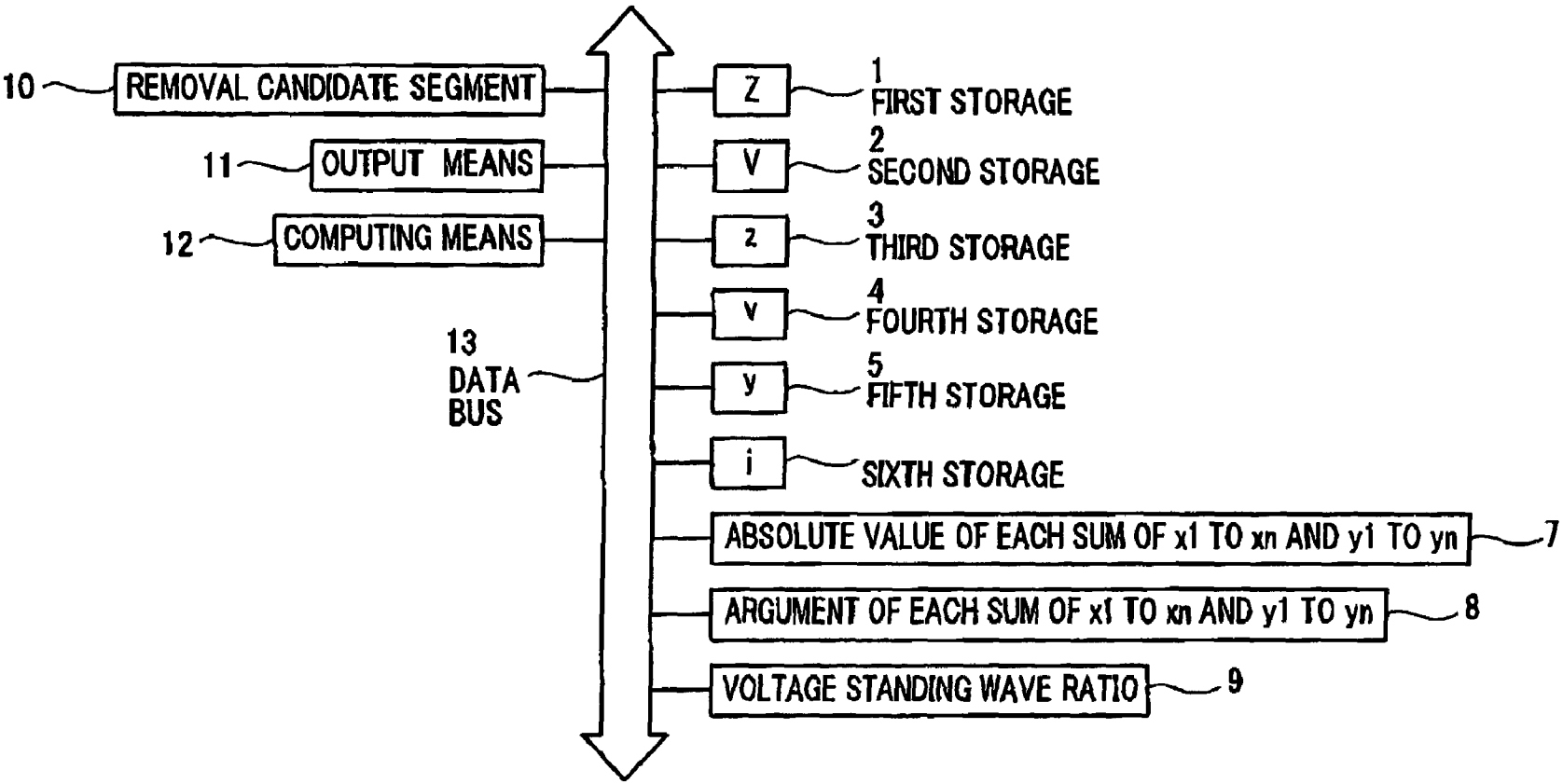
FIG. 3 is a schematic diagram illustrating an antenna design simulator in another preferred embodiment according to the invention of the invention.

FIG. 3 is a schematic diagram illustrating an antenna design simulator in another preferred embodiment according to the invention of the invention.

The antenna design simulator in FIG. 3 features the tenth storage 10 as shown in FIG. 1 that stores removal candidate segments such that an antenna structure as the design target can be obtain based on the tenth storage 10. Meanwhile, the other components other than the tenth storage 10 to store the removal candidate segments are the same as those in FIG. 1.

In operation, when a removal candidate segment is sequentially outputted from the tenth storage 10, the computing means 12 computes the antenna characteristics in the case of removing the removal candidate segment and it determines whether the antenna structure as the design target is obtained.

Figure 4:
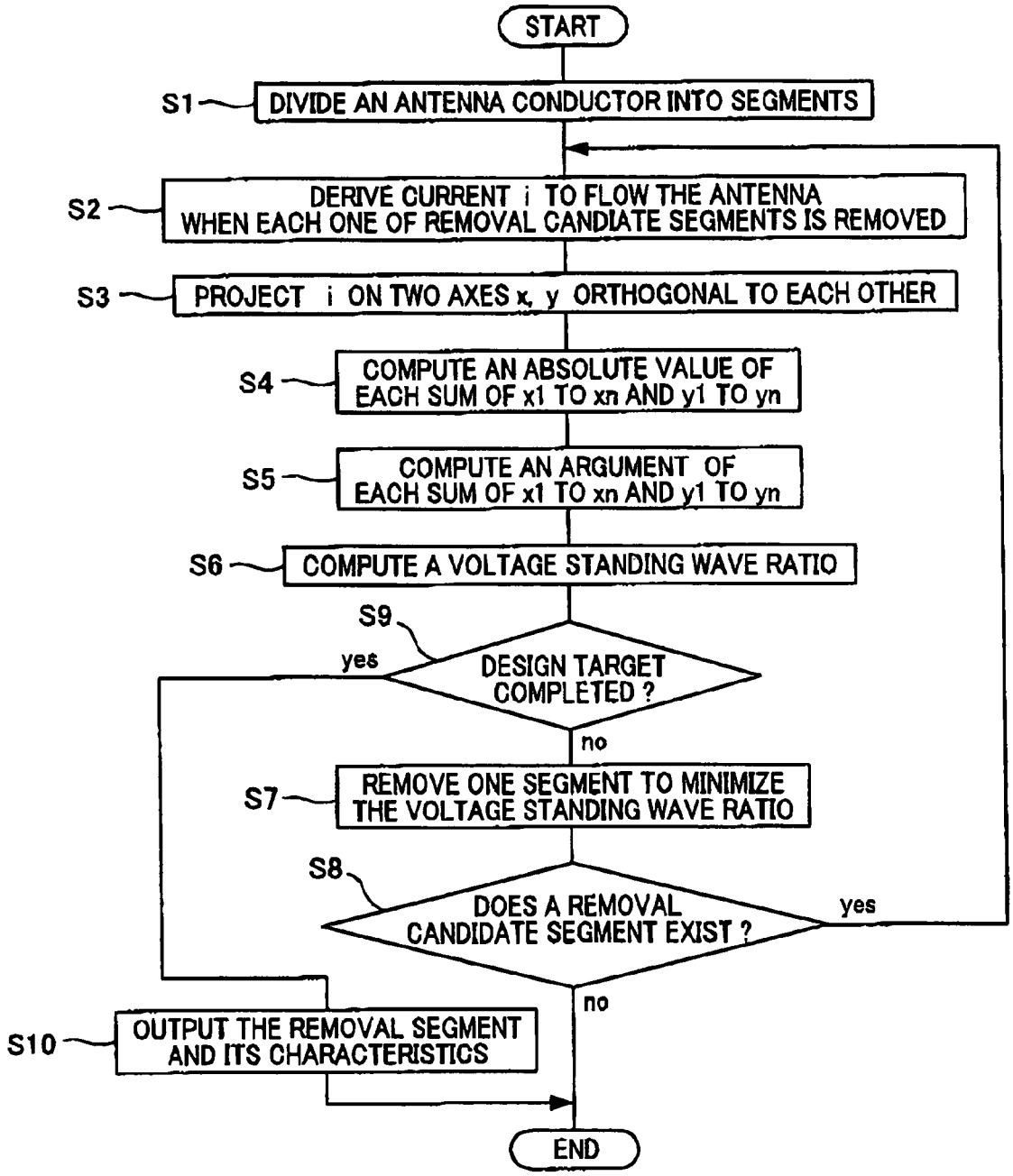
FIG. 4 is a flow chart showing a design algorism of the antenna design simulator in FIG. 3.

FIG. 4 is a flow chart showing a design algorism of the antenna design simulator in FIG. 3.

As shown in FIG. 4, a metal conductor to compose the antenna is divided into a finite number of segments (S1), and then a current vector i when the removal candidate segments are one by one removed is computed and stored by using the moment method to estimate current in at least two directions (S2). Then, the components $i_1$ to $i_n$ of the vector i are projected on at least one set of the two mutually-perpendicular axes x, y (S3), and then, provided that each component thereof is represented as x1 to xn and y1 to yn, the absolute value of the sum of x1 to xn and the absolute value of the sum of y1 to yn are computed and stored (S4). The argument of the sum of x1 to xn and the argument of the sum of y1 to yn are computed and stored (S5), the voltage standing wave ratio given by the expression 1, where $z_f$ is the impedance of a high-frequency circuit to feed electric power to the antenna, $i_e$ is a component corresponding to the feeding point of the vector i, and $v_e$ is a component corresponding to the feeding point of the vector v, is computed and stored (S6). Then, it is judged whether the voltage standing wave ratio meets the design target (S9), where if no, then a removal candidate segment is determined to minimize the voltage standing wave ratio and is removed, and this result is stored (S7). Then, it is judged whether a removal candidate segment exists (S8), where if no, then the algorism ends, and if yes, then returned to S2.

Thus, in each loop, it is judged whether the design target is attained after S6 (S9), where if no, then it proceeds to S7, and if yes, then the removed segment and the characteristics of the structure are outputted (S10) and the algorism ends.

The design target can be determined by that 1) the absolute value of the sum of x1 to xn is nearly equal to the absolute value of the sum of y1 to yn (as a concrete value, the ratio between the absolute values is 0.7 to 1.3, preferably 0.9 to 1.1), 2) the absolute value of a difference between the argument of the sum of x1 to xn and the argument of the sum of y1 to yn is nearly 90 degrees (as a concrete value, 80 to 100 degrees), and 3) the voltage standing wave ratio is smaller than a predetermined value (as a concrete value, it is 3.0 or less, preferably 2.0 or less).

The design algorism as shown in FIG. 4 will be detailed below in reference to a simple example.

Figure 5:
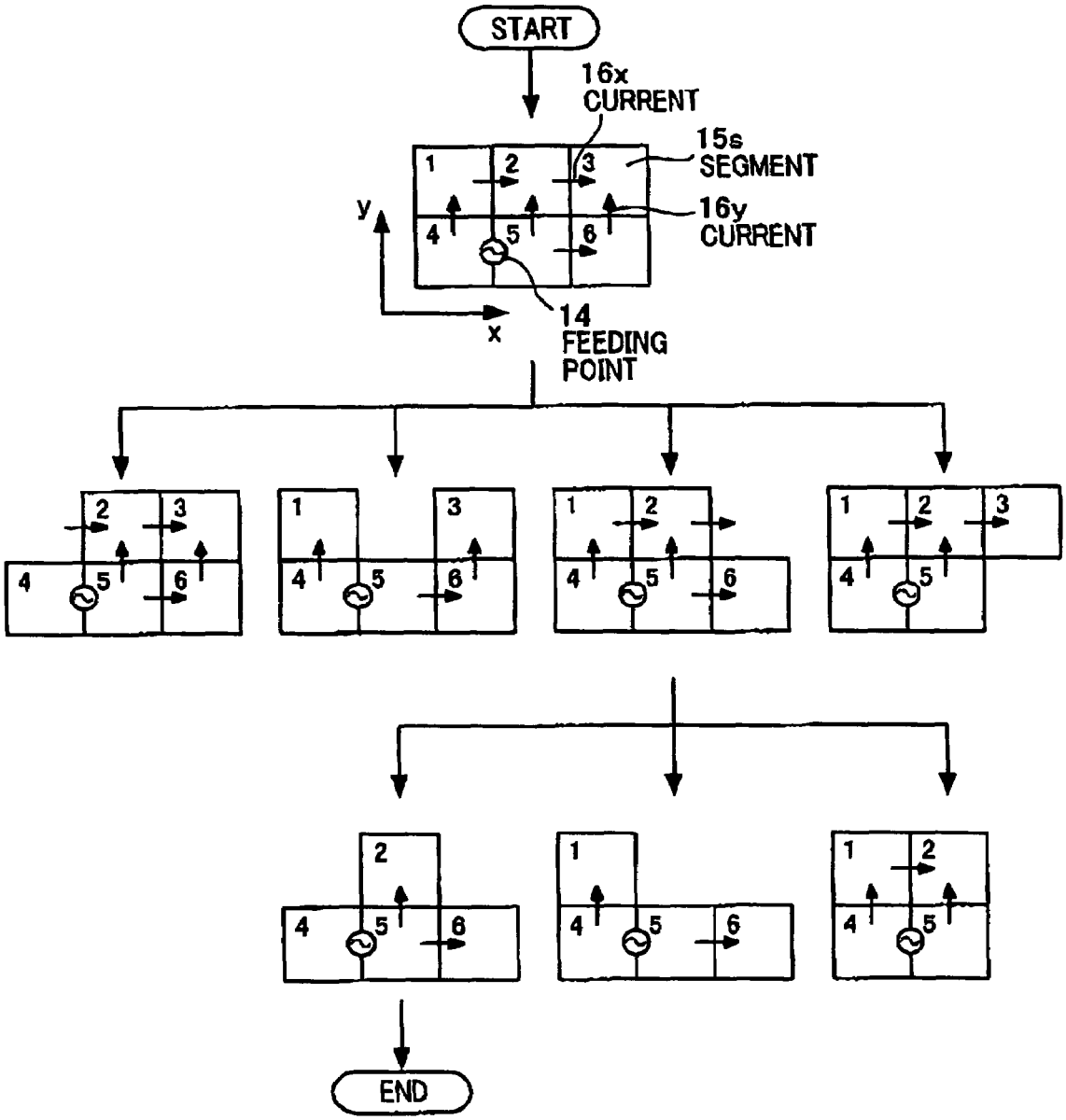
FIG. 5 is a schematic diagram illustrating a transition of an antenna structure according to the design algorism in FIG. 4.

FIG. 5 is a schematic diagram illustrating a transition of an antenna structure according to the design algorism in FIG. 4.

The feeding point 14 is disposed in the metal conductor 15 to compose the antenna, the metal conductor 15 is divided into, e.g., six segments 15*s*, and currents 16*x* and 16*y* are estimated (S1). Since segments 15*s* relating to the feeding point 14 cannot be removed, the segments s1, s2, s3 and s6 are removal candidate segments.

Then, current i when any of the removal candidate segments is removed is derived (S2), the components $i_1$ to $i_n$ of the vector i are projected on at least one set of the two mutually-perpendicular axes x, y (S3), and then, provided that each component thereof is represented as x1 to xn and y1 to yn, the absolute value of the sum of x1 to xn and the absolute value of the sum of y1 to yn are computed and stored (S4). Then, the argument of the sum of x1 to xn and the argument of the sum of y1 to yn are computed and stored (S5), the voltage standing wave ratio given by the expression 1 is computed and stored (S6).

Then, it is judged whether the design target is attained (S9). In this example, since none of four structures attains the design target, it proceeds to S7. Then, the voltage standing wave ratios when each removal candidate segment is removed are compared, and a removal candidate segment to minimize the voltage standing wave ratio is removed (S7). In this example, since the voltage standing wave ratio is minimized when the segment s3 is removed, the segment s3 is removed.

Then, it is judged whether a removal candidate segment exits (S8). Since the segments s1, s2 and s6 are the removal candidate segment, it proceeds to S2. Then, current i when any of the removal candidate segments is removed is derived (S2), the components $i_1$ to $i_n$ of the vector i are projected on at least one set of the two mutually-perpendicular axes x, y (S3), and then, provided that each component thereof is represented as x1 to xn and y1 to yn, the absolute value of the sum of x1 to xn and the absolute value of the sum of y1 to yn are computed and stored (S4). Then, the argument of the sum of x1 to xn and the argument of the sum of y1 to yn are computed and stored (S5), the voltage standing wave ratio given by the expression 1 is computed and stored (S6).

Then, it is judged whether the design target is attained (S9). In this example, since the design target is attained when the removal candidate segment s1 is removed, it proceeds to S10. The removed segments and its characteristics are outputted (S10) and the algorism ends. Thus, in this example, the removed segments are s1 and s3.

As described above, the antenna design simulator of the invention is operated such that the structure design is conducted to minimize the voltage standing wave ratio, and a structure to satisfy the circular polarization is searched in each process of the design. Therefore, its design efficiency can be enhanced and the design time can be further reduced.

FIG. 6 is a structural diagram showing the circular polarized antenna A1 to be designed by using the antenna design simulator according to the invention as shown in FIGS. 1 and 3.

The circular polarized antenna as shown in FIG. 6 is an antenna that can be applied to GPS (global positioning system) and can transmit/receive a circular polarized wave at about 1575 MHz.

The outer size of the planar metal conductor 15 to compose the circular polarized antenna A1 is 48 mm×48 mm. The feeding point 14 is disposed nearly at the center of the metal conductor 15.

Further, as shown in FIG. 7, the metal conductor 15 is divided into 3 mm×3 mm segments 15*s*, and current 16 is defined between the segments 15*s*. Currents 16*x*, 16*y* are projected onto the two mutually-perpendicular axes x, y in FIG. 7.

When the antenna is designed by suitably removing the segment 15*s* from the metal conductor 15 as shown in FIG. 7 according to the flow chart in FIG. 4, the structure as shown in FIG. 6 can be obtained.

In this example, the design target is determined by that 1) a ratio between the absolute value of the sum of x1 to xn and the absolute value of the sum of y1 to yn is 0.7 or more and 1.3 or less, preferably 0.9 or more and 1.1 or less, 2) the absolute value of a difference between the argument of the sum of x1 to xn and the argument of the sum of y1 to yn is 80 degrees or more and 100 degrees or less, and 3) the voltage standing wave ratio when the high-frequency circuit has an impedance of 50 Ω is 3.0 or less, preferably 2.0 or less.

Figure 8A:
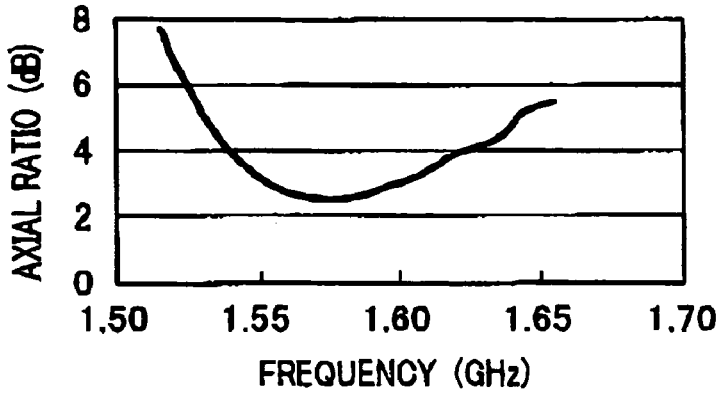
FIGS. 8A and 8B are characteristic diagrams showing characteristics of the antenna structure in FIG. 6.
Figure 8B:
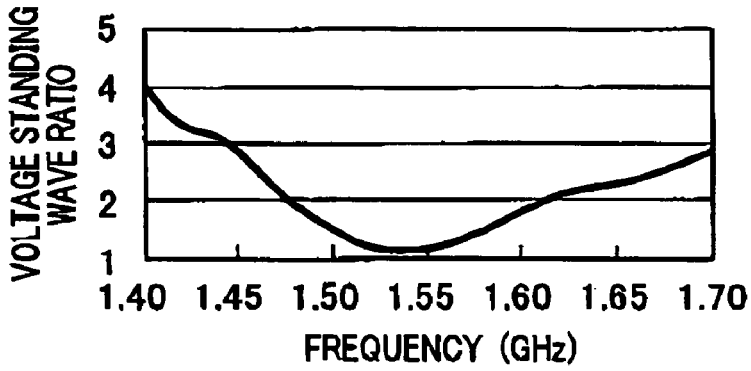

As the result of making the circular polarized antenna A1 structured as shown in FIG. 6, its characteristics are observed as shown in FIGS. 8A and 8B.

Although it is generally accepted that a circular polarized antenna with an axial ratio of 3.0 dB or less is good, as shown in FIG. 8A, the circular polarized antenna A1 has an axial ratio of 2.6 dB at a predetermined frequency (=1575 MHz). Therefore, it can function sufficiently as a circular polarized antenna.

Further, as shown in FIG. 8B, it has a voltage standing wave ratio of about 1.4 and, therefore, can be well matched to the high-frequency circuit.

The outer size of the circular polarized antenna A1 is 49 mm which is about a fourth of a wavelength at the working frequency. Thus, the circular polarized antenna A1 is sized significantly smaller than the conventional circular polarized antennas. Further, since it is composed of the planar metal conductor, it is significantly lower-profiled than the conventional circular polarized antennas.

Accordingly, the circular polarized antenna designed by using the antenna design simulator of the invention can have good characteristics in circular polarization and good matching to the high-frequency circuit. Further, it can be downsized and low-profiled.

Next, another preferred embodiment of the invention will be explained below referring to FIG. 9.

Figure 9:
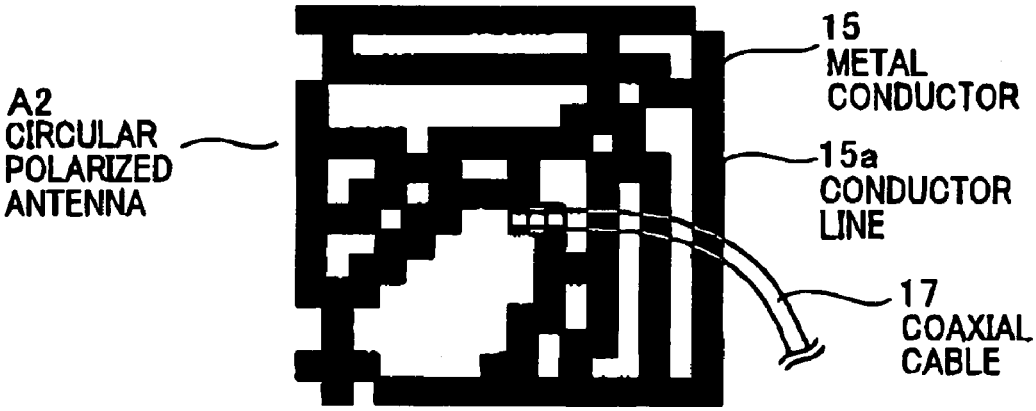
FIG. 9 is a structural diagram showing a circular polarized antenna in another preferred embodiment according to the invention.

FIG. 9 is a structural diagram showing a circular polarized antenna A2 in another preferred embodiment according to the invention. The circular polarized antenna A2 comprises the planar metal conductor 15 with a group of conductor lines 15*a* as shown in FIG. 6.

Figure 10:
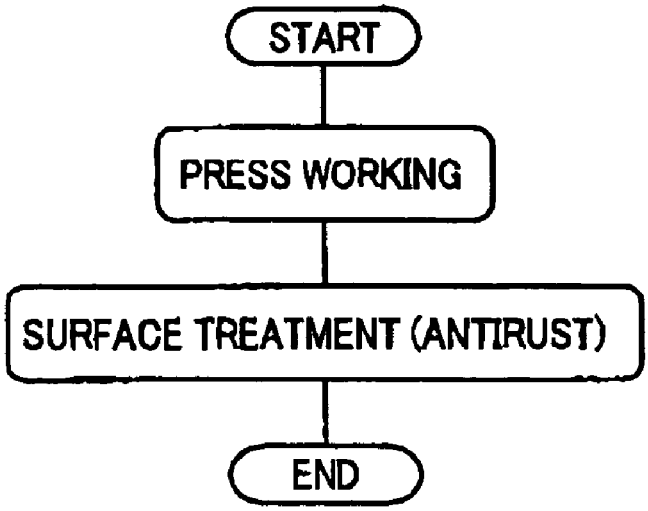
FIG. 10 is a flow chart showing a process of making an circular polarized antenna of the invention.

The circular polarized antenna A2 is made in a process as shown in FIG. 10.

The metal conductor 15 is shaped by press working and is subjected to surface treatment. Further, a coaxial cable 17 is connected to the feeding point 14.

Thus, the circular polarized antenna of this embodiment can be easy made by a general metal working like the press working. Further, feeding at a low loss can be obtained by the coaxial cable. Therefore, reduction in radiation efficiency can be prevented.

Figure 11:
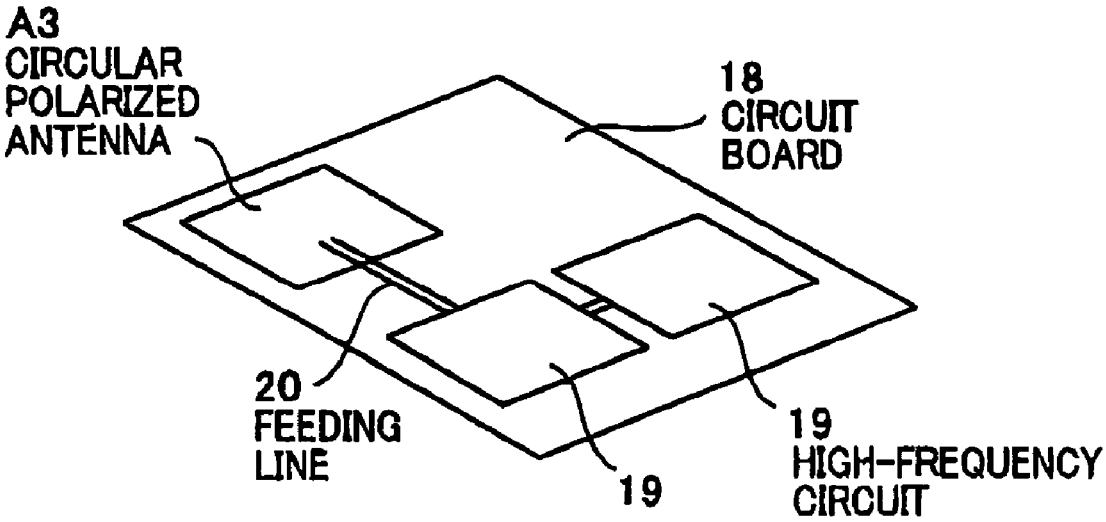
FIG. 11 is a perspective view showing a wireless module with a circular polarized antenna of the invention.

FIG. 11 is a perspective view showing a wireless module with a circular polarized antenna A3 of the invention.

The wireless module is provided with the circular polarized antenna A3 with the conductor structure as shown in FIG. 6.

In the wireless module, high-frequency power is supplied from a high-frequency circuit 19, which is disposed on a circuit board 18, through a feeding line 20 to the antenna A3. The antenna structure is adjusted in consideration of an influence to be generated when it is mounted on the circuit board 18. Thereby, the circular polarized wave can be well transmitted and received.

Accordingly, the wireless module with the circular polarized antenna of the invention can be obtained which has a high performance as well as being downsized and low-profiled.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A circular polarized antenna, comprising:

a group of conductor lines that comprise a planar metal conductor; and a feeding point connected to a part of the conductor lines, wherein when a current to be induced on the conductor lines is projected onto two mutually-perpendicular axes to define projections and arguments therebetween, a ratio between absolute values of the projections is 0.7 to 1.3 and an absolute value of a difference between the arguments is 80 to 100 degrees, and a reactance component of an impedance of the feeing point is nearly zero.

2. The circular polarized antenna according to claim 1, wherein:

the metal conductor is divided into a finite number of segments, and the group of conductor lines are formed by removing a part of the segments.

3. A wireless module comprising:

the circular polarized antenna as defined in claim 1.

4. An antenna design simulator, comprising:

connecting a feeding point to a part of a group of conductor lines that comprise a planar metal conductor;

computing a current to be induced on the conductor lines;

projecting the current onto two mutually-perpendicular axes to define projections and arguments therebetween;

judging whether a ratio between absolute values of the projections is 0.7 to 1.3;

judging whether an absolute value of a difference between the arguments is 80 to 100 degrees; and judging whether an impedance of the feeing point is matched to an impedance of a high-frequency circuit.

5. The antenna design simulator according to claim 4, further comprising:

a computing means that is operable to repeatedly change a structure of the conductor lines to allow the feeding point to have an impedance match to a high-frequency circuit, wherein every time when the structure of the conductor lines is changed, the simulator judges whether the ratio between absolute values of the projections is 0.7 to 1.3, and whether the absolute value of the difference between the arguments is 80 to 100 degrees.

6. The antenna design simulator according to claim 4, wherein:

the metal conductor is divided into a finite number of segments, and the group of conductor lines are formed by removing a part of the segments.

7. The antenna design simulator according to claim 6, wherein:

the current is estimated by using the moment method between segments in at least two directions not parallel to each other.

8. The antenna design simulator according to claim 7, further comprising:

a first storage that stores a matrix Z of rank N with the order of an impedance;

a second storage that stores a vector V of rank N with the order of a voltage;

a third storage that stores a matrix z of rank n (n<N) obtained by deleting plural rows and columns from the matrix Z;

a fourth storage that stores a vector v obtained by deleting plural rows from the vector V;

a fifth storage that stores a matrix y of rank n with the order of an admittance to define an inverse matrix of the matrix z;

a sixth storage that stores a vector i of rank n with the order of a current obtained as a product of the matrix y and the vector v; and a computing means that designs a vector i by using the first to sixth storages, wherein provided that components obtained when components i1 to i7 of the vector i are projected onto two mutually-perpendicular axes are represented as x1 to xn and y1 to yn, the vector i is designed such that an absolute value of the sum of x1 to xn is nearly equal to an absolute value of the sum of y1 to yn, the vector i is designed such that an absolute value of a difference between an argument of the sum of x1 to xn and an argument of the sum of y1 to yn is nearly 90 degrees, and the vector i is designed such that, provided that $z_f$ is the impedance of the high-frequency circuit, $i_e$ is a component corresponding to the feeding point of the vector i, and $v_e$ is a component corresponding to the feeding point of the vector v, the $z_f$ is nearly equal to $v_e/i_e$, or such that a voltage standing wave ratio represented by:

$$(1+|(v_e/i_e-z_f)/(v_e/i_e+z_f)|)/(1-|(v_e/i_e-z_f)/(v_e/i_e+z_f)|)$$

is minimized.

9. The antenna design simulator according to claim 8, further comprising:

a tenth storage that stores a removal candidate segment to be removed from the divided segments of the metal conductor;

a seventh storage that stores an absolute value of the sum of x1 to xn and an absolute value of the sum of y1 to yn, provided that components obtained when components i1 to i7 of a vector I are projected onto two mutually-perpendicular axes are represented as x1 to xn and y1 to yn, the vector I being computed by the computing means by using the first to sixth storages for each current of the removal candidate segment;

an eighth storage that stores an argument of the sum of x1 to xn and an argument of the sum y1 to yn; and a ninth storage that stores a voltage standing wave ratio when $z_f$ is the impedance of the high-frequency circuit, $i_e$ is a component corresponding to the feeding point of the vector I, and $v_e$ is a component corresponding to the feeding point of the vector v, wherein the computing means repeatedly computes the voltage standing wave ratio of the removal candidate segment from the tenth storage until the removal candidate segment does not exist, and judges, in reference to the seventh to ninth storages, a removal candidate segment that allows that an absolute value of the sum of x1 to xn is nearly equal to an absolute value of the sum of y1 to yn, that an absolute value of a difference between an argument of the sum of x1 to xn and an argument of the sum of y1 to yn is nearly 90 degrees, and that the voltage standing wave ratio is smaller than a predetermined value, and the simulator further comprises an output means that outputs the judged removal candidate segment.

10. A wireless module comprising:

a circular polarized antenna designed by the antenna design simulator as defined in claim 4.

* * * * *

UNITED STATES PATENT AND TRADEMARK OFFICE

CERTIFICATE OF CORRECTION

PATENT NO. : 7,394,426 B2
APPLICATION NO. : 11/352405
DATED : July 1, 2008
INVENTOR(S) : Hiroyuki Kimura et al.

It is certified that error appears in the above-identified patent and that said Letters Patent is hereby corrected as shown below:

Abstract, line 9 delete “feeing point” and insert --feeding point--

Column 2, line 18, delete “a antenna” and insert --an antenna--

Column 2, line 32 delete “feeing point” and insert --feeding point--

Column 6, line 7 delete “(1+|(ve/ie-zf)/(ve/ie+zf)|)/(1-|(ve/ie-zf)/(ve/ie+zf)|)” and insert --(1+|(ve/ie-zf)/(ve/ie+zf)|)/(1-|(ve/ie-zf)/(ve/ie+zf)|) ... ...--

Column 8, line 26 delete “exits (S8)” and insert --exists (S8)--

Column 9, line 26 delete “A1 is 49” and insert --A1 is 48--

Column 10, line 22 delete “feeing point” and insert --feeding point--

Column 10, line 43 delete “feeing point” and insert --feeding point--

Signed and Sealed this

Sixteenth Day of December, 2008

JON W. DUDAS
*Director of the United States Patent and Trademark Office*